US007044109B2

(12) United States Patent
Ricco

(10) Patent No.: US 7,044,109 B2
(45) Date of Patent: May 16, 2006

(54) INTERNAL COMBUSTION ENGINE FUEL INJECTOR

(75) Inventor: Mario Ricco, Casamassima (IT)

(73) Assignee: C.R.F. Societa Consortile per Azioni, Orbassano (IT)

( * ) Notice: Subject to any disclaimer, the term of this patent is extended or adjusted under 35 U.S.C. 154(b) by 156 days.

(21) Appl. No.: 10/162,220

(22) Filed: Jun. 5, 2002

(65) Prior Publication Data

US 2003/0006297 A1 Jan. 9, 2003

(30) Foreign Application Priority Data

Jun. 5, 2001 (IT) ..... TO2001A0539

(51) Int. Cl.
*F02M 41/00* (2006.01)

(52) U.S. Cl. ..... 123/467; 123/500; 239/96

(58) Field of Classification Search ..... 123/467, 123/500, 501, 458, 446; 239/88–96, 533.3
See application file for complete search history.

(56) References Cited

U.S. PATENT DOCUMENTS 3,680,782 A 8/1972 Monpetit et al.
4,684,067 A * 8/1987 Cotter et al. ..... 239/533.3
5,685,483 A 11/1997 Ganser
5,979,410 A * 11/1999 Grieshaber ..... 123/467
6,131,540 A * 10/2000 Bronkal ..... 123/467
6,209,524 B1 * 4/2001 Itoh ..... 123/467
6,234,404 B1 * 5/2001 Cooke ..... 239/88
6,293,254 B1 * 9/2001 Crofts et al. ..... 123/467

FOREIGN PATENT DOCUMENTS

| | | |
|---|---|---|
| DE | 4427378 | 2/1996 |
| FR | 2815383 | 4/2002 |
| WO | 01/38723 | 5/2001 |

* cited by examiner

*Primary Examiner*—Carl S. Miller
(74) *Attorney, Agent, or Firm*—Crowell & Moring LLP

(57) ABSTRACT

An internal combustion engine fuel injector has a casing defining a nozzle; and a shutter pin having an axis, and housed in axially sliding manner inside the casing to close the nozzle by virtue of a control rod. The pin and the control rod are connected by a connecting device, which has an axial seat carried by the pin, and a head interposed between the axial seat and the control rod, and which engages the axial seat to transmit to the pin a resultant of forces directed solely along the pin axis.

23 Claims, 3 Drawing Sheets

INTERNAL COMBUSTION ENGINE FUEL INJECTOR

The present invention relates to an internal combustion engine fuel injector.

BACKGROUND OF THE INVENTION

Fuel injectors are known which comprise an inlet connected to a fuel supply pump; a nozzle communicating with the inlet to inject fuel into the engine; and a shutter pin, which is moved axially, to open and close the nozzle, by the opposite axial thrusts exerted by the pressure of the injected fuel, on one side, and by a positioning spring and a control rod, on the other.

The control rod is located along the axis of the pin, on the opposite side to the nozzle, is activated by an electromagnetic metering valve forming part of the injector, and is connected to the pin with the axial interposition of a cylindrical spacer body.

The spacer body is defined by two opposite flat surfaces crosswise to the axis and resting on the flat ends of the control rod and pin respectively, and is of an axial height calibrated according to given classes, and which is selected as a function of the desired maximum lift or axial stroke of the pin.

Known injectors of the above type are not always satisfactory, owing to the resultant of the contact pressures between the spacer body and the pin being applied at a normally indefinite point, and normally generating on the pin undesired transverse forces crosswise to the axis.

The pressures exerted by the spacer body on the pin, in fact, are not always distributed evenly over the mutually contacting surfaces, mainly on account of inevitable flatness and roughness tolerances, so that the resultant of the pressures sometimes generates on the pin rotation torques about a direction perpendicular to the pin axis.

Said transverse forces are sometimes also generated by the mutually contacting surfaces of the spacer body and pin not being perfectly perpendicular to the pin axis.

Such transverse forces produce relatively severe friction forces along the seat in which the pin slides, thus resulting in an anomalous increase in wear and, therefore, in the radial clearance between the pin and seat. This in turn results in an undesired increase in leakage of the unused fuel, which flows out of the injector through a recirculating outlet.

The increase in leakage and, therefore, in the amount of fuel recirculated may result in the pump being unable to supply the injectors in all engine operating conditions.

SUMMARY OF THE INVENTION

It is an object of the present invention to provide an internal combustion engine injector designed to provide a straightforward, low-cost solution to the above drawbacks.

According to the present invention, there is provided a fuel injector for an internal combustion engine; the injector comprising a casing defining a nozzle for injecting fuel into said engine; a shutter having an axis and housed in axially sliding manner inside said casing to open and close said nozzle; control means for pushing said shutter towards said nozzle to close the nozzle; and connecting means for connecting said shutter to said control means; characterized in that said connecting means comprise an axial seat carried by one of said shutter and said control means; and a head interposed between said axial seat and the other of said shutter and said control means, and engaging said axial seat so as to transmit to said shutter a resultant of forces directed solely along said axis of said shutter.

BRIEF DESCRIPTION OF THE DRAWINGS

A non-limiting embodiment of the invention will be described by way of example with reference to the accompanying drawings, in which.

DETAILED DESCRIPTION OF THE INVENTION

Figure 1:
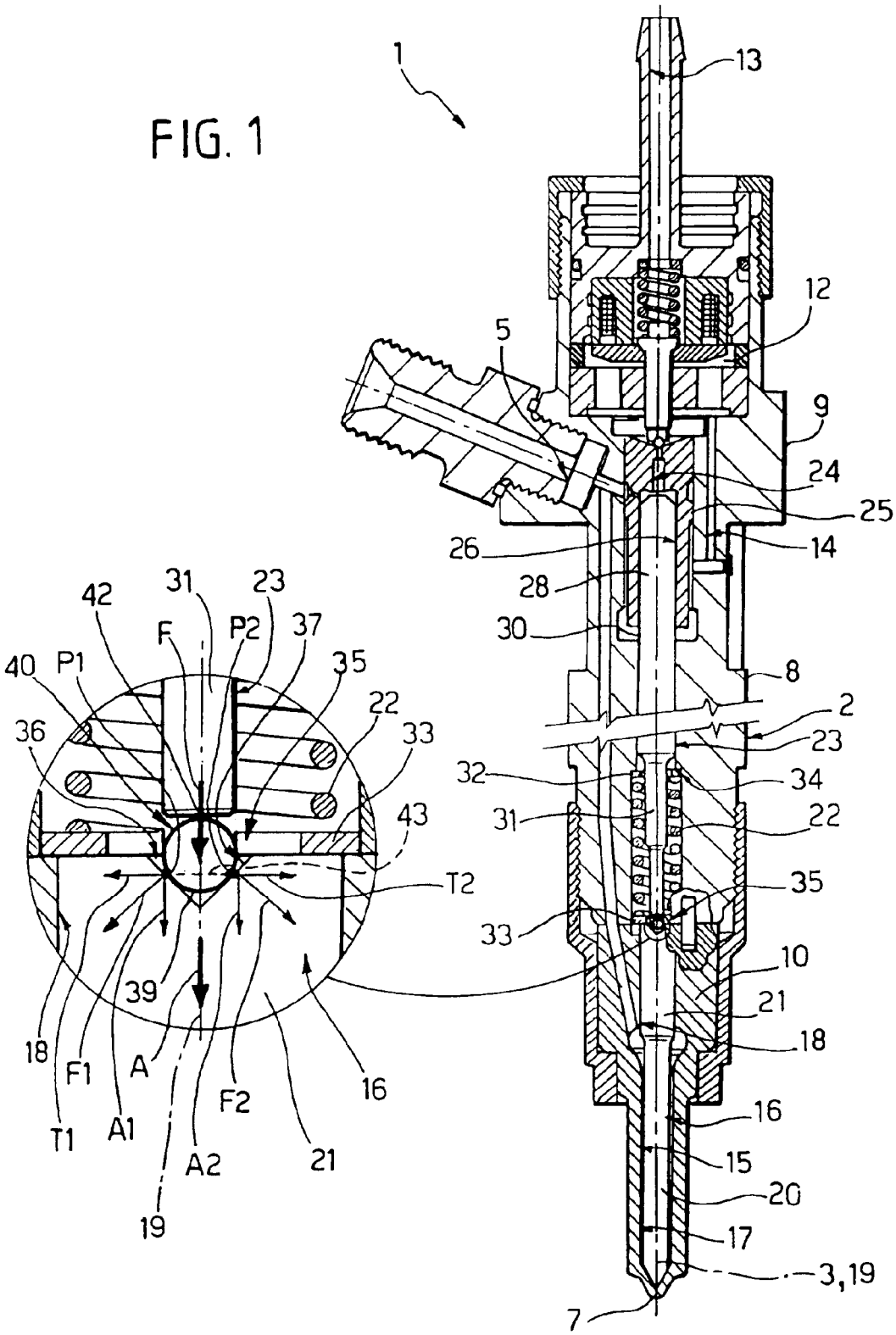
FIG. 1 shows a cross section, with parts removed for clarity, of a first preferred embodiment of the internal combustion engine injector according to the present invention.

Number 1 in FIG. 1 indicates a fuel injector for an internal combustion engine, in particular a diesel engine (not shown). Injector 1 comprises a hollow outer structure or casing 2 extending along an axis 3, and having a lateral inlet 5 for connection to a pump forming part of a fuel supply system (not shown), and an end nozzle 7 communicating with inlet 5 to inject fuel into a relative cylinder of the engine.

Casing 2 comprises an intermediate axial portion 8, and two opposite end portions 9, 10. Portion 9 is located on the opposite side to nozzle 7, and houses a known electromagnetic metering valve 12 (not described in detail) having an outlet 13 for recirculating back to the supply system tank (not shown) the portion of fuel "consumed" by valve 12, and the portion of fuel leaking through the internal components of injector 1, and which is fed to valve 12 along an inner conduit 14.

Portion 10 is a so-called atomizer, and defines a cylindrical axial chamber 15 housing a shutter pin 16, and comprising a channel 17 terminating in nozzle 7, and a guide seat 18.

Pin 16 has an axis 19 coincident with axis 3, and comprises a rod 20 housed in channel 17; and a cylindrical head portion 21, which is slid axially with relatively little clearance inside seat 18, to allow the tip of rod 20 to open and close nozzle 7, by the opposite axial thrusts exerted, on one side, by the pressure of the fuel in channel 17, and, on the other, by a positioning spring 22 and an axial control rod 23.

Rod 23 is activated by valve 12 to slide axially inside portion 8, and is subjected, in particular, to the opposite axial thrusts of the reaction of pin 16 and the pressure of the fuel inside an axial control chamber 24 communicating with inlet 5 and controlled by valve 12. Chamber 24 is defined by a tubular body 25, which has a cylindrical axial guide seat 26 communicating with chamber 24 and engaged in sliding manner and with relatively little radial clearance by an end portion 28 of rod 23.

With reference to FIG. 1, rod 23 comprises two opposite portions 30, 31. Portion 30 faces valve 12 and terminates with portion 28; while portion 31 is smaller in diameter than portion 30, and is surrounded by spring 22, which is interposed between two spacer rings 32, 33 resting axially on a shoulder 34 of portion 8 and on portion 21 respectively.

Portion 21 is connected to portion 31 by a connecting device 35 for transmitting from rod 23 to pin 16 a resultant of forces A directed solely along axis 19.

Device 35 comprises a cavity 36 formed, coaxially with axis 19, in portion 21 and defined by a conical surface 37; and a spherical spacer body 39 interposed between pin 16 and rod 23, and engaging cavity 36. Body 39 is defined by a spherical surface 40 resting, on one side, on the flat end of portion 31, at a point of contact 42 along axis 19, and, on the other side, on conical surface 37, along a circular line of contact 43 (shown by a dash line in FIGS. 1, 2 and 3).

The diameter of body 39 is calibrated according to given classes, and is selected as a function of the desired maximum lift or axial stroke of pin 16.

Figure 2:
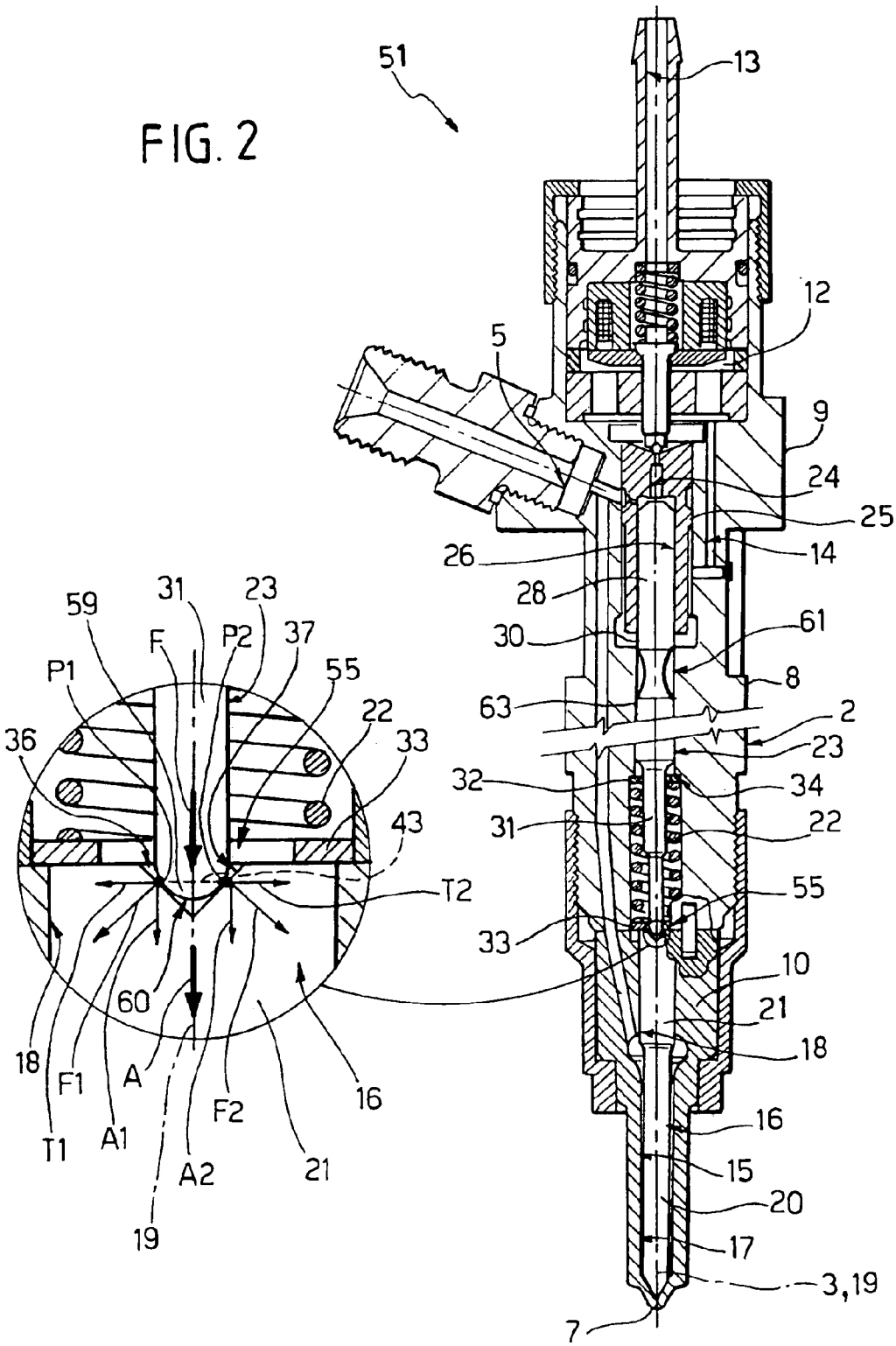
FIG. 2 shows the same view as in FIG. 1, of a second preferred embodiment of the internal combustion engine injector according to the present invention.

The FIG. 2 embodiment relates to a fuel injector 51, the component parts of which are indicated, where possible, using the same reference numbers as for injector 1. Injector 51 is a so-called "virtual lift" type, i.e. comprises a pin 16, which slides axially inside seat 15 to open nozzle 7 without ever reaching a predetermined axial limit position, and which therefore has no fixed maximum lift value.

Injector 51 differs from injector 1 substantially by having no body 39. Instead of device 35, injector 51 therefore comprises a connecting device 55, in turn comprising cavity 36, and a hemispherical head 59 integral with rod 23 and defining the axial end of portion 31. Head 59 engages cavity 36, and is defined by a spherical surface 60 having the same curvature as surface 40, and resting on conical surface 37 along contact line 43.

Device 55 also comprises a weakened portion of rod 23, defined by a circumferential groove 61 formed in an intermediate portion 63 of portion 30, outside seat 26, and which allows portion 31 a relatively limited amount of freedom to flex with respect to portion 28 in a direction crosswise to axis 3, so as to center head 59 automatically inside cavity 36, i.e. to position spherical surface 60 perfectly coaxial with conical surface 37.

In injector 1, body 39 is also, obviously, centered automatically inside cavity 36, by being movable crosswise to rod 23 at point of contact 42.

Figure 3:
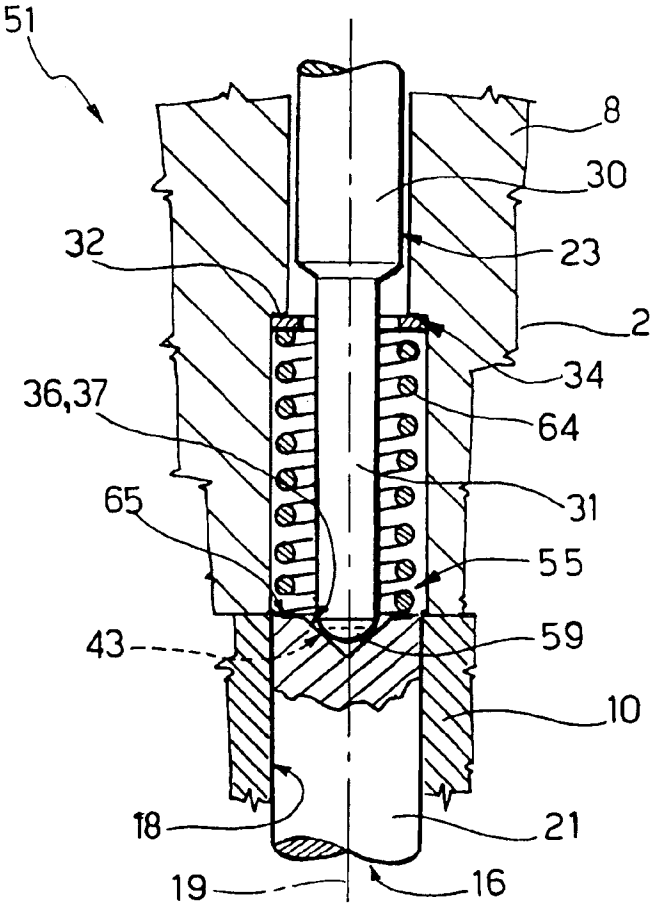
FIGS. 3 and 4 show larger-scale views of respective variations of a detail of the FIG. 2 injector.

In the FIG. 3 variation, to simplify production, spring 22 is replaced by a spring 64 resting, on one side, on spacer ring 32, and, on the other, on a flat surface 65 defining portion 21 directly, without ring 33. The same variation may also be applied to injector 1.

Figure 4:
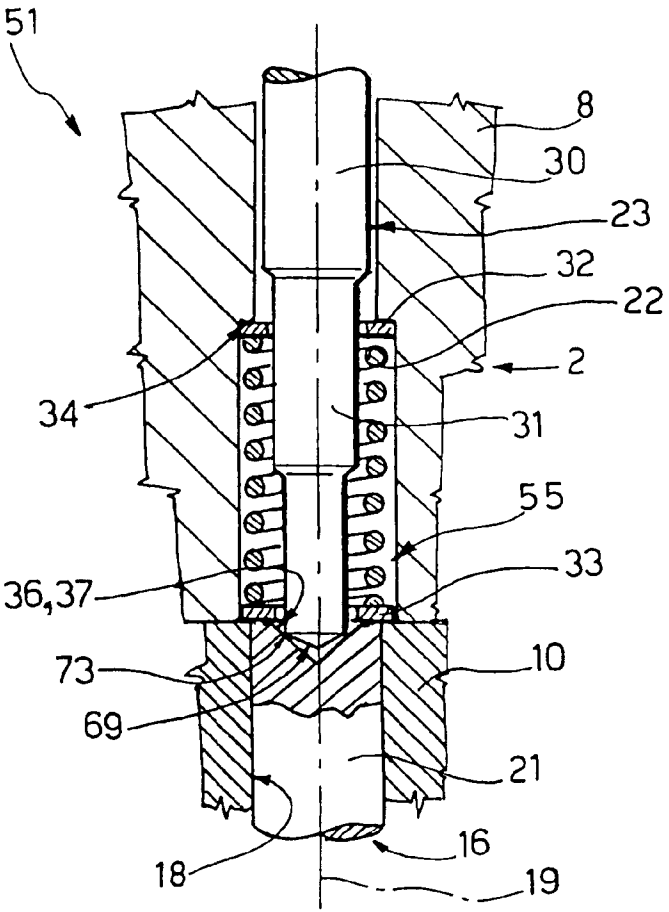

In the FIG. 4 variation, to simplify production, hemispherical head 59 is replaced by a conical head 69 resting on conical surface 37 along a line of contact 73 defined by the circular edge connecting head 69 to the rest of portion 31.

In actual use, rod 23 exerts an axial thrust F, which is transmitted along line of contact 43, 73 in a direction perpendicular to conical surface 37 to move pin 16 towards, and so close, nozzle 7. Given a generic diametric section, as shown in the larger-scale details in FIGS. 1 and 2, diametrically opposite points P1 and P2 along line of contact 43 are subjected to respective forces F1 and F2 of equal modulus, by thrust F being directed coaxially with conical surface 37.

If each force F1, F2 is divided into a respective component A1, A2 directed parallel to axis 19, and a respective component T1, T2 directed perpendicularly to axis 19, components T1 and T2 are equal and opposite, and therefore give rise to a zero resultant; whereas components A1 and A2, being equal and concordant and applied at respective points P1, P2 symmetrical with respect to axis 19, give rise to a resultant of forces A acting on pin 16 and directed solely along axis 19.

As a result of microdeformations in body 39 and heads 59, 69 along relative lines of contact 43, 73, lines of contact 43, 73 are in fact defined by annular areas of contact, which, however, are so small as to have no effect on the above resolution of forces.

Devices 35, 55 connecting pin 16 to rod 23 therefore provide for reducing the increase in wear and, therefore, radial clearance between seat 18 and portion 21, by pin 16 receiving from rod 23 a resultant of forces A having no component crosswise to axis 19.

Moreover, devices 35, 55 are relatively straightforward, by comprising a fairly small number of components, and by only requiring precision machining to ensure surface 37 is coaxial with the cylindrical lateral surface of portion 21 sliding inside seat 18; and, unlike known solutions, surface 65 of portion 21 need not be perfectly flat and perpendicular to axis 19.

Since, in the case of "virtual lift" injectors, the lift of pin 16 need not be calibrated by an appropriately sized spacer body, injector 51, as compared with known solutions, is extremely straightforward by comprising no intermediate body between rod 23 and pin 16.

Clearly, changes may be made to injectors 1, 51 as described and illustrated herein without, however, departing from the scope of the present invention.

In particular, cavity 36, head 59, 69 and/or body 39 may be defined by contacting surfaces other than surfaces 37, 40, 60, but still interacting with one another to transmit from rod 23 to pin 16 a resultant of forces A directed solely along axis 19.

Also, cavity 36 may be formed axially in the end of rod 23, and head 59, 69 may be carried by pin 16.

What is claimed is:

1. A fuel injector for an internal combustion engine; the injector comprising a casing defining a nozzle for injecting fuel into said engine; a one-piece rigid shutter having an axis and housed in axially sliding manner inside said casing, wherein the shutter includes a flat end surface and an axial seat arranged on the flat end surface and wherein the shutter opens and closes the nozzle; a control rod for pushing said shutter towards said nozzle to close the nozzle, wherein a head is disposed between the control rod and the axial seat; wherein the axial seat and the head are engaged so as to transmit to said shutter a resultant of forces (A) directed solely along said axis of said shutter.

2. An injector as claimed in claim 1, wherein said axial seat and said head interact with each other along an annular line of contact symmetrical with respect to said axis.

3. An injector as claimed in claim 2, wherein said annular line of contact is a circular line.

4. A fuel injector for an internal combustion engine; the injector comprising a casing defining a nozzle for injecting fuel into said engine; a shutter having an axis and housed in axially sliding manner inside said casing to open and close said nozzle; control means for pushing said shutter towards said nozzle to close the nozzle; and connecting means for connecting said shutter to said control means; wherein said connecting means comprise an axial seat carried by one of said shutter and said control means; and a head interposed between said axial seat and the other of said shutter and said control means, and engaging said axial seat so as to transmit to said shutter a resultant of forces (A) directed solely along said axis of said shutter, wherein said axial seat and said head interact with each other along an annular line of contact symmetrical with respect to said axis, wherein said annular line of contact is a circular line and, wherein said axial seat is defined by a conical surface coaxial with said axis.

5. An injector as claimed in claim 3, wherein said head is at least partly defined by a spherical surface engaging said axial seat.

6. An injector as claimed in claim 4, wherein said head comprises a conical portion engaging said axial seat.

7. An injector as claimed in claim 2, wherein said annular line of contact defines part of an annular area of contact.

8. A fuel injector for an internal combustion engine; the injector comprising a casing defining a nozzle for injecting fuel into said engine; a shutter having an axis and housed in axially sliding manner inside said casing to open and close said nozzle; control means for pushing said shutter towards said nozzle to close the nozzle; and connecting means for connecting said shutter to said control means; wherein said connecting means comprise an axial seat carried by one of said shutter and said control means; and a head interposed between said axial seat and the other of said shutter and said control means, and engaging said axial seat so as to transmit to said shutter a resultant of forces (A) directed solely along said axis of said shutter, wherein said axial seat is formed in said shutter.

9. An injector as claimed in claim 8, wherein said control means comprise a control rod extending along said axis; said head being carried by said control rod.

10. An injector as claimed in claim 9, wherein said head is defined by a spherical body resting on said control rod at a point of contact lying along said axis.

11. An injector as claimed in claim 9, wherein said head defines the end of said control rod.

12. An injector as claimed in claim 11, wherein comprising a guide seat for guiding said control rod; said control rod comprising an end portion engaging said guide seat in axially sliding manner, and a weakened intermediate portion allowing said head to flex with respect to the end portion in directions crosswise to said axis.

13. An injector as claimed in claim 12, wherein said weakened intermediate portion has a circumferential groove.

14. An injector as claimed in claim 1, wherein comprising elastic means interposed axially between said shutter and said casing.

15. An injector as claimed in claim 14, wherein said elastic means rest axially directly on said shutter.

16. An injector as claimed in claim 3, wherein said axial seat is defined by a conical surface coaxial with said axis.

17. An injector as claimed in claim 16, wherein said head comprises a conical portion engaging said axial seat.

18. An injector as claimed in claim 1, wherein said axial seat is formed in said shutter.

19. An injector as claimed in claim 18, wherein said control means comprise a control rod extending along said axis; said head being carried by said control rod.

20. An injector as claimed in claim 19, wherein said head is defined by a spherical body resting on said control rod at a point of contact lying along said axis.

21. An injector as claimed in claim 19, wherein said head defines the end of said control rod.

22. An injector as claimed in claim 21, wherein comprising a guide seat for guiding said control rod; said control rod comprising an end portion engaging said guide seat in axially sliding manner, and a weakened intermediate portion allowing said head to flex with respect to the end portion in directions crosswise to said axis.

23. An injector as claimed in claim 22, wherein said weakened intermediate portion has a circumferential groove.

* * * * *